US010876401B1

(12) United States Patent
Taitt et al.

(10) Patent No.: US 10,876,401 B1
(45) Date of Patent: Dec. 29, 2020

(54) ROTATIONAL STYLE TOOL BIT ASSEMBLY

(71) Applicants: Ronnie R. Taitt, Herrin, IL (US); Phillip Sollami, Herrin, IL (US)

(72) Inventors: Ronnie R. Taitt, Herrin, IL (US); Phillip Sollami, Herrin, IL (US)

(73) Assignee: The Sollami Company, Herrin, IL (US)

( * ) Notice: Subject to any disclaimer, the term of this patent is extended or adjusted under 35 U.S.C. 154(b) by 0 days.

(21) Appl. No.: 15/649,895

(22) Filed: Jul. 14, 2017

Related U.S. Application Data

(60) Provisional application No. 62/366,779, filed on Jul. 26, 2016.

(51) Int. Cl.

| | |
|---|---|
| ***E21C 35/18*** | (2006.01) |
| ***E21C 35/197*** | (2006.01) |
| ***E21C 35/183*** | (2006.01) |
| *B25B 15/00* | (2006.01) |
| *B25B 23/10* | (2006.01) |
| *B25B 21/02* | (2006.01) |
| *B25B 23/00* | (2006.01) |
| *B25B 21/00* | (2006.01) |

(52) U.S. Cl.
CPC ..... *E21C 35/1831* (2020.05); *E21C 35/18* (2013.01); *E21C 35/197* (2013.01); *B25B 15/00* (2013.01); *B25B 15/005* (2013.01); *B25B 21/00* (2013.01); *B25B 21/02* (2013.01); *B25B 23/00* (2013.01); *B25B 23/108* (2013.01)

(58) Field of Classification Search
CPC ..... E21C 35/18; E21C 35/19; E21C 35/197; E21C 2035/191; E21C 35/183; E21C 35/1831; E21C 35/1833; E21C 35/1835; E21C 35/1837
USPC ..... 299/106, 107, 110, 111
See application file for complete search history.

(56) References Cited

U.S. PATENT DOCUMENTS

| | | | | |
|---|---|---|---|---|
| 3,342,532 A | | 9/1967 | Krekeler | |
| 3,397,012 A | | 8/1968 | Krekeler | |
| 3,476,438 A | * | 11/1969 | Bower, Jr. | E21C 35/18 175/377 |
| 3,519,309 A | | 7/1970 | Engle | |
| 3,833,264 A | * | 9/1974 | Elders | E21C 35/18 175/354 |

(Continued)

FOREIGN PATENT DOCUMENTS

| | | |
|---|---|---|
| DE | 102004049710 | 4/2006 |
| DE | 102011079115 | 1/2013 |

(Continued)

*Primary Examiner* — David J Bagnell
*Assistant Examiner* — Michael A Goodwin
(74) *Attorney, Agent, or Firm* — Mercedes V. O'Connor; Rockman Videbeck & O'Connor

(57) ABSTRACT

A bit assembly includes a base block and a bit holder having a forward body portion and a generally cylindrical shank. The forward body portion includes a plurality of vanes that define a plurality of cavities or flutes configured to carry removable size pieces from a trenched area to the adjacent surface alongside a trenching machine. The spaced cavities are supported by the vertical vanes that also aid in removing the loosened material. The shank of the bit holder includes an annular groove configured to receive a bit retainer once the bit holder is inserted into a bore of a base block.

20 Claims, 5 Drawing Sheets

(56) References Cited

U.S. PATENT DOCUMENTS 3,833,265 A * 9/1974 Elders ..... E21C 35/183 175/354
3,865,437 A 2/1975 Crosby
4,065,185 A * 12/1977 Elders ..... E21C 35/18 299/110
4,084,856 A 4/1978 Emmerich
4,247,150 A 1/1981 Wrulich et al.
RE30,807 E * 12/1981 Elders ..... E21C 35/18 175/354
4,310,939 A 1/1982 Iijima
4,453,775 A 6/1984 Clemmow
4,478,298 A 10/1984 Hake
4,489,986 A 12/1984 Dziak
4,525,178 A 6/1985 Hall
4,561,698 A 12/1985 Beebe
4,570,726 A 2/1986 Hall
4,604,106 A 8/1986 Hall
4,694,918 A 9/1987 Hall
4,702,525 A 10/1987 Sollami
4,711,504 A * 12/1987 Berchem ..... E21C 35/197 299/106
4,763,956 A 8/1988 Emmerich
4,811,801 A 3/1989 Salesky
4,818,027 A 4/1989 Simon
4,844,550 A 7/1989 Beebe
4,915,455 A 4/1990 O'Neill
4,944,559 A 7/1990 Sionett
5,067,775 A 11/1991 D'Angelo
5,088,797 A 2/1992 O'Neill
5,098,167 A 3/1992 Latham
5,159,233 A 10/1992 Sponseller
5,161,627 A 11/1992 Burkett
5,273,343 A 12/1993 Ojanen
5,287,937 A 2/1994 Sollami
5,302,005 A 4/1994 O'Neill
5,303,984 A 4/1994 Ojanen
5,352,079 A 10/1994 Croskey
5,370,448 A 12/1994 Sterwerf, Jr.
5,374,111 A 12/1994 Den Besten
5,415,462 A 5/1995 Massa
5,417,475 A * 5/1995 Graham ..... E21B 10/46 175/427
5,458,210 A 10/1995 Sollami
5,492,188 A 2/1996 Smith et al.
5,551,760 A * 9/1996 Sollami ..... E21B 10/567 299/105
5,607,206 A 3/1997 Siddle
5,628,549 A 5/1997 Ritchey
5,725,283 A 3/1998 O'Neill
5,823,632 A 10/1998 Burkett
5,924,501 A 7/1999 Tibbitts
5,931,542 A 8/1999 Britzke
5,992,405 A 11/1999 Sollami
D420,013 S 2/2000 Warren
6,019,434 A * 2/2000 Emmerich ..... E21C 35/183 299/111
6,102,486 A 8/2000 Briese
6,176,552 B1 1/2001 Topka, Jr.
6,196,340 B1 3/2001 Jensen et al.
6,199,451 B1 3/2001 Sollami
6,250,535 B1 6/2001 Sollami
6,331,035 B1 12/2001 Montgomery, Jr.
6,341,823 B1 * 1/2002 Sollami ..... E21C 35/18 299/101
6,354,771 B1 * 3/2002 Bauschulte ..... E21C 35/183 175/427
6,357,832 B1 3/2002 Sollami
6,371,567 B1 4/2002 Sollami
6,508,516 B1 1/2003 Kammerer
D471,211 S 3/2003 Sollami
6,585,326 B2 7/2003 Sollami
6,685,273 B1 2/2004 Sollami
6,692,083 B2 2/2004 Latham
D488,170 S 4/2004 Sollami
6,733,087 B2 5/2004 Hall
6,739,327 B2 * 5/2004 Sollami ..... B28D 1/188 125/36
6,786,557 B2 9/2004 Montgomery
6,824,225 B2 11/2004 Stiffler
6,846,045 B2 1/2005 Sollami
6,854,810 B2 2/2005 Montgomery
6,866,343 B2 3/2005 Holl et al.
6,968,912 B2 11/2005 Sollami
6,981,496 B2 * 1/2006 Szendrovari ..... B25D 17/02 125/40
6,994,404 B1 2/2006 Sollami
7,097,258 B2 8/2006 Sollami
7,118,181 B2 10/2006 Frear
7,150,505 B2 12/2006 Sollami
7,195,321 B1 3/2007 Sollami
7,210,744 B2 5/2007 Montgomery
7,229,136 B2 6/2007 Sollami
7,234,782 B2 6/2007 Stehney
D554,162 S 10/2007 Hall
7,320,505 B1 1/2008 Hall
7,338,135 B1 3/2008 Hall
7,347,292 B1 3/2008 Hall
D566,137 S 4/2008 Hall
7,353,893 B1 4/2008 Hall
7,384,105 B2 6/2008 Hall
7,396,086 B1 6/2008 Hall
7,401,862 B2 7/2008 Holl et al.
7,401,863 B1 7/2008 Hall
7,410,221 B2 8/2008 Hall
7,413,256 B2 8/2008 Hall
7,413,258 B2 8/2008 Hall
7,419,224 B2 9/2008 Hall
7,445,294 B2 11/2008 Hall
D581,952 S 12/2008 Hall
7,464,993 B2 12/2008 Hall
7,469,756 B2 12/2008 Hall
7,469,971 B2 12/2008 Hall
7,469,972 B2 12/2008 Hall
7,475,948 B2 1/2009 Hall
7,523,794 B2 4/2009 Hall
7,568,770 B2 8/2009 Hall
7,569,249 B2 8/2009 Hall
7,571,782 B2 8/2009 Hall
7,575,425 B2 8/2009 Hall
7,588,102 B2 9/2009 Hall
7,594,703 B2 9/2009 Hall
7,600,544 B1 10/2009 Sollami
7,600,823 B2 10/2009 Hall
7,628,233 B1 12/2009 Hall
7,635,168 B2 12/2009 Hall
7,637,574 B2 12/2009 Hall
7,648,210 B2 1/2010 Hall
7,665,552 B2 2/2010 Hall
7,669,938 B2 3/2010 Hall
7,681,338 B2 3/2010 Hall
7,712,693 B2 5/2010 Hall
7,717,365 B2 5/2010 Hall
7,722,127 B2 5/2010 Hall
7,789,468 B2 9/2010 Sollami
7,832,808 B2 11/2010 Hall
7,883,155 B2 2/2011 Sollami
7,950,745 B2 5/2011 Sollami
7,963,617 B2 6/2011 Hall
3,007,049 A1 8/2011 Fader
7,992,944 B2 8/2011 Hall
7,992,945 B2 8/2011 Hall
7,997,661 B2 8/2011 Hall
8,007,051 B2 8/2011 Hall
8,029,068 B2 10/2011 Hall
8,033,615 B2 10/2011 Hall
8,033,616 B2 10/2011 Hall
8,038,223 B2 10/2011 Hall
8,061,784 B2 11/2011 Hall
8,109,349 B2 2/2012 Hall
8,118,371 B2 2/2012 Hall
8,136,887 B2 3/2012 Hall
8,201,892 B2 6/2012 Hall
8,215,420 B2 7/2012 Hall

(56) References Cited

U.S. PATENT DOCUMENTS

| | | | | |
|---|---|---|---|---|
| 8,292,372 | B2 | 10/2012 | Hall | |
| 8,414,085 | B2 | 4/2013 | Hall | |
| 8,449,039 | B2 | 5/2013 | Hall | |
| 8,485,609 | B2 | 7/2013 | Hall | |
| 8,500,209 | B2 | 8/2013 | Hall | |
| 8,540,320 | B2 | 9/2013 | Sollami | |
| RE44,690 | E | 1/2014 | Sollami | |
| 8,622,482 | B2 | 1/2014 | Sollami | |
| 8,622,483 | B2 | 1/2014 | Sollami | |
| 8,646,848 | B2 | 2/2014 | Hall | |
| 8,728,382 | B2 | 5/2014 | Hall | |
| 9,004,610 | B2 | 4/2015 | Erdmann et al. | |
| 9,028,008 | B1 | 5/2015 | Bookhamer | |
| 9,039,099 | B2 | 5/2015 | Sollami | |
| 9,316,061 | B2 | 4/2016 | Hall | |
| 9,518,464 | B2 | 12/2016 | Sollami | |
| 9,909,416 | B1 | 3/2018 | Sollami | |
| 9,976,418 | B2 | 5/2018 | Sollami | |
| 9,988,903 | B2 | 6/2018 | Sollami | |
| 10,072,501 | B2 | 9/2018 | Sollami | |
| 10,105,870 | B1 | 10/2018 | Sollami | |
| 10,107,097 | B1 | 10/2018 | Sollami | |
| 10,107,098 | B2 | 10/2018 | Sollami | |
| 10,180,065 | B1 | 1/2019 | Sollami | |
| 10,260,342 | B1 | 4/2019 | Sollami | |
| 10,323,515 | B1 | 6/2019 | Sollami | |
| 10,337,324 | B2 | 7/2019 | Sollami | |
| 10,370,966 | B1 | 8/2019 | Sollami | |
| 10,385,689 | B1 | 8/2019 | Sollami | |
| 10,415,386 | B1 | 9/2019 | Sollami | |
| 10,502,056 | B2 | 12/2019 | Sollami | |
| 2002/0167216 | A1 | 11/2002 | Sollami | |
| 2003/0015907 | A1 | 1/2003 | Sollami | |
| 2003/0047985 | A1 | 3/2003 | Stiffler | |
| 2003/0209366 | A1 | 11/2003 | McAlvain | |
| 2004/0004389 | A1 | 1/2004 | Latham | |
| 2004/0174065 | A1 | 9/2004 | Sollami | |
| 2006/0071538 | A1 | 4/2006 | Sollami | |
| 2006/0186724 | A1 | 8/2006 | Stehney | |
| 2006/0261663 | A1* | 11/2006 | Sollami | E21C 35/197 299/104 |
| 2008/0035386 | A1 | 2/2008 | Hall et al. | |
| 2008/0036283 | A1 | 2/2008 | Hall et al. | |
| 2008/0145686 | A1 | 6/2008 | Mirchandani | |
| 2008/0284234 | A1 | 11/2008 | Hall et al. | |
| 2009/0256413 | A1 | 10/2009 | Majagi | |
| 2009/0261646 | A1 | 10/2009 | Ritchie et al. | |
| 2010/0244545 | A1 | 9/2010 | Hall | |
| 2010/0253130 | A1 | 10/2010 | Sollami | |
| 2010/0320003 | A1* | 12/2010 | Sollami | E21C 35/183 175/420.1 |
| 2011/0006588 | A1 | 1/2011 | Monyak et al. | |
| 2011/0089747 | A1 | 4/2011 | Helsel | |
| 2011/0204703 | A1 | 8/2011 | Sollami | |
| 2011/0241409 | A1* | 10/2011 | Swope | E02F 9/2858 299/111 |
| 2011/0254350 | A1 | 10/2011 | Hall | |
| 2012/0027514 | A1 | 2/2012 | Hall | |
| 2012/0068527 | A1 | 3/2012 | Erdmann | |
| 2012/0104830 | A1* | 5/2012 | Monyak | E21C 35/18 299/29 |
| 2012/0181845 | A1 | 7/2012 | Sollami | |
| 2012/0248663 | A1 | 10/2012 | Hall | |
| 2012/0261977 | A1 | 10/2012 | Hall | |
| 2012/0280559 | A1 | 11/2012 | Watson | |
| 2012/0286559 | A1 | 11/2012 | Sollami | |
| 2012/0319454 | A1 | 12/2012 | Swope | |
| 2013/0002004 | A1* | 1/2013 | Greenspan | E02F 9/2866 299/101 |
| 2013/0169023 | A1 | 7/2013 | Monyak | |
| 2014/0326516 | A1 | 11/2014 | Haugvaldstad | |
| 2015/0028656 | A1 | 1/2015 | Sollami | |
| 2015/0035343 | A1 | 2/2015 | Ojanen | |
| 2015/0137579 | A1 | 5/2015 | Lachmann et al. | |
| 2015/0198040 | A1 | 7/2015 | Voitic et al. | |
| 2015/0240634 | A1 | 8/2015 | Sollami | |
| 2015/0285074 | A1 | 10/2015 | Sollami | |
| 2015/0292325 | A1 | 10/2015 | Sollami | |
| 2015/0300166 | A1 | 10/2015 | Ries et al. | |
| 2015/0308488 | A1 | 10/2015 | Kahl | |
| 2015/0315910 | A1 | 11/2015 | Sollami | |
| 2015/0354285 | A1 | 12/2015 | Hall | |
| 2016/0194956 | A1 | 7/2016 | Sollami | |
| 2016/0229084 | A1 | 8/2016 | Lehnert | |
| 2017/0089198 | A1 | 3/2017 | Sollami | |

FOREIGN PATENT DOCUMENTS

| | | |
|---|---|---|
| DE | 202012100353 | 6/2013 |
| DE | 102015121953 | 7/2016 |
| DE | 102016118658 | 3/2017 |
| EP | 3214261 | 9/2017 |
| GB | 1114156 | 5/1968 |
| GB | 2483157 | 2/2012 |
| GB | 2534370 | 7/2016 |
| WO | 2008105915 A2 | 9/2008 |
| WO | 2008105915 A3 | 9/2008 |
| WO | 2009006612 | 1/2009 |

* cited by examiner

ROTATIONAL STYLE TOOL BIT ASSEMBLY

CROSS-REFERENCE TO RELATED APPLICATION(S)

This application claims priority to U.S. Provisional Application No. 62/366,779, filed Jul. 26, 2016, to the extent allowed by law and the contents of which are incorporated herein by reference in their entireties.

TECHNICAL FIELD

This disclosure relates to bit assemblies for road milling, mining, and trenching equipment.

BACKGROUND

Road milling, mining, and trenching equipment utilizes bits or inserts traditionally set in a bit assembly having a bit holder and a bit holder block. The insert is retained within the bit holder which is retained within a bore in the bit holder block. A plurality of the bit assemblies are mounted on the outside of a rotatable drum, typically in a V-shaped or spiral configuration, or the plates are mounted to a chain driven boom or a wheel trencher. The combinations of bit assemblies have been utilized to remove material from the terra *firma*, such as degrading the surface of the earth, minerals, cement, concrete, macadam or asphalt pavement. Individual bits, bit holders, and bit holder blocks may wear down or break over time due to the harsh cutting environment. In various trenching cutting conditions, a hardened insert, such as a tungsten carbide insert, is used to initially impact the surface material and break it down into smaller removable pieces which are then carried outside the trenched area to the adjacent surface alongside the trenching machine. The bit assembly of the present disclosure uses a hardened insert in combination with a bit holder having vertical vanes configured to aid in removing the loosened material, assist in the rotation of the tool, and allow the profile at the forward end of the tool to wear symmetrically.

SUMMARY

This disclosure relates generally to bit assemblies for road milling, mining, and trenching equipment. One implementation of the teachings herein is a bit holder that includes a forward body portion comprising a plurality of vanes axially and radially extending from a top surface of the body portion to a generally cylindrical tire portion of the body portion; and a generally cylindrical shank depending axially from the forward body portion, the shank comprising an annular groove adjacent a distal end of the shank.

In another implementation of the teachings herein is a bit holder that includes a forward body portion comprising at least one vane axially and radially extending from a top surface of the body portion to a generally cylindrical tire portion of the body portion; and a generally cylindrical shank depending axially from the forward body portion, the shank comprising an annular groove adjacent a distal end of the shank.

These and other aspects of the present disclosure are disclosed in the following detailed description of the embodiments, the appended claims and the accompanying figures.

BRIEF DESCRIPTION OF THE DRAWINGS

The various features, advantages, and other uses of the apparatus will become more apparent by referring to the following detailed description and drawings, wherein like reference numerals refer to like parts throughout the several views. It is emphasized that, according to common practice, the various features of the drawings are not to-scale. On the contrary, the dimensions of the various features are arbitrarily expanded or reduced for clarity.

DETAILED DESCRIPTION

Road milling, mining, and trenching equipment utilizes bits or inserts traditionally set in a bit assembly having a bit holder, comprising a bit holder body and a shank, and a bit holder block. The insert is retained within the bit holder which is retained within a bore in the bit holder block, hereinafter referred to as the base block. The base block supports the tool and is welded to its support member. The combinations of bit assemblies have been utilized to remove material from the terra firma, such as degrading the surface of the earth, minerals, cement, concrete, macadam or asphalt pavement. The tool of the present disclosure is designed to be used in various trenching cutting conditions, whether cutting rock formations, cutting a combination of rock and dirt or soil, or removing strictly soil. The tool includes a hardened insert, such as a tungsten carbide insert, brazed into a pocket or seat at the forward end of the tool. The hardened insert is used to initially impact the surface material and break it down into removable size pieces that fit within the pocket or space between the vanes of the tool and carry the removable size pieces outside the trenched area to the adjacent surface alongside the trenching machine. The spaced cavities of the tool are supported by vertical vanes that also aid in removing loosened material. The vertical vanes of the tool are also configured to aid in the rotation of the tool as well, which allows the profile at the forward end of the tool to wear symmetrically.

Figure 6:
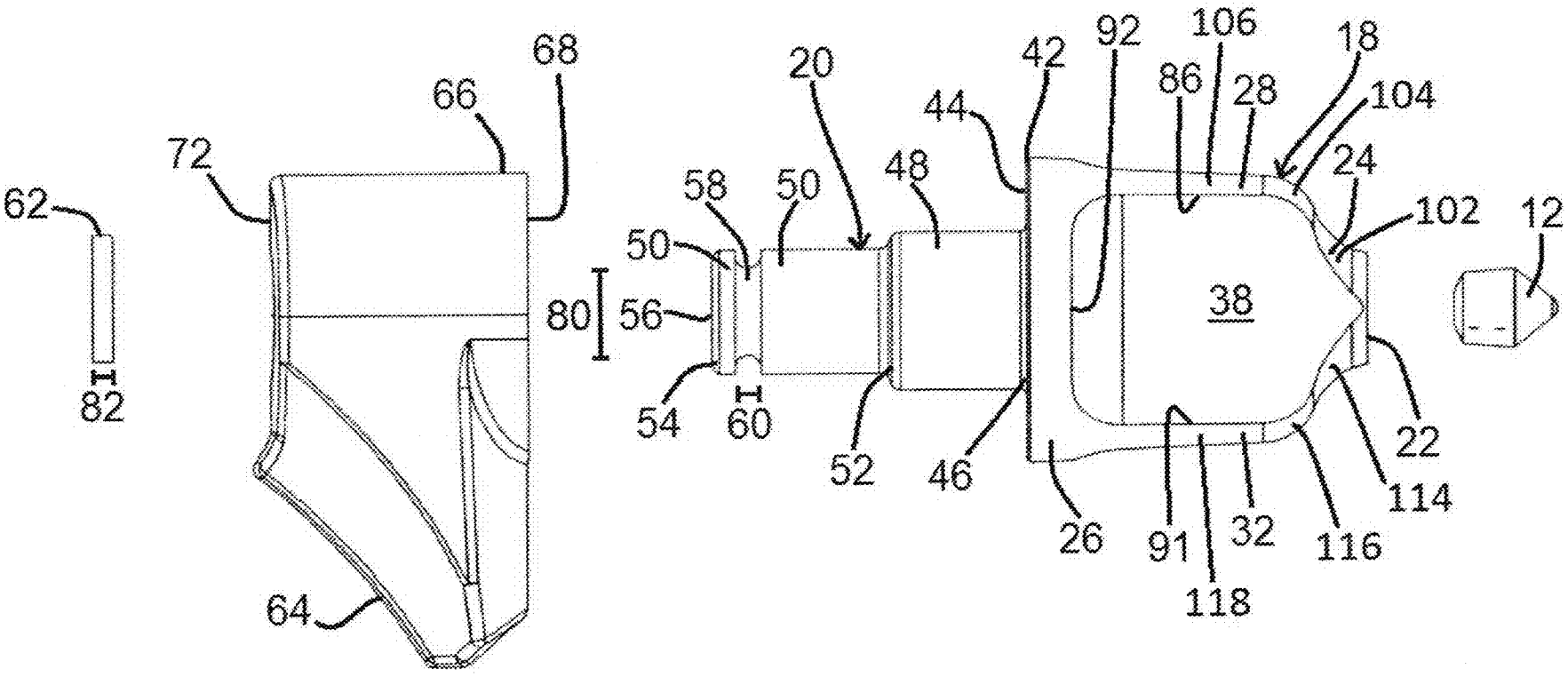
FIG. 6 is an exploded side elevation view of the embodiment of the bit assembly of FIG. 1.

Referring to FIGS. 1-7, an illustrated embodiment of a rotational style tool bit assembly 10 comprises a hardened insert 12, a bit holder 14, and a base block 16. The bit holder 14 includes a bit holder body 18 and a shank 20, as shown in FIG. 6, axially depending from the bottom of the bit holder body 18. The bit holder body 18 comprises a forward body portion 24 that extends axially and radially outwardly from a flat top surface 22 to a radially extending generally cylindrical tire portion 26. The tire portion 26 extends downwardly to a chamfer 42, shown in FIG. 6, that defines the outside of a rear flange, such as a rear flat annular flange 44 in this embodiment. A decreased diameter tapered distal portion 46, subjacent to the tire portion 26, extends from the rear flange 44. The flat top surface 22 comprises a generally cylindrical bore 40, shown in FIG. 7, axially and centrally positioned in bit holder body 18, into which the insert 12 may be positioned and brazed.

In this illustrated embodiment, the forward body portion 24 comprises three radially extending wings or vanes 28, 30, 32 that axially extend from the flat top surface 22 to the tire portion 26. The vanes 28, 30, 32 converge proximate the axis of rotation A, shown in FIG. 7, on the flat top surface 22 and diverge radially towards the tire portion 26. Each vane is separated from the next vane by an arcuate cavity or flute. In this illustrated embodiment, shown in FIG. 3, an outer edge 87 of vane 28, an outer edge 88 of vane 30, and an upper edge 93 of tire portion 26 define cavity 34, an outer edge 89 of vane 30, an outer edge 90 of vane 32, and an upper edge 94 of tire portion 26 define cavity 36, and an outer edge 91 of vane 32, an outer edge 86 vane 28, and an upper edge 92 of tire portion 26 define cavity 38. In this illustrated embodiment, vane 28 comprises an outer surface between outer edge 86 and outer edge 87 that includes a concave outer surface 102 (FIGS. 1, 2, 6, and 6A) adjacent the flat top surface 22, a convex outer surface 104 (FIGS. 1, 2, 6, and 6A) adjacent the concave outer surface 102, and a laterally extending outer surface 106 (FIGS. 1, 2, 6, and 6A) adjacent the convex outer surface 104 that extends to the tire portion 26, vane 30 comprises an outer surface between outer edge 88 and outer edge 89 that includes a concave outer surface 108 (FIG. 5) adjacent the flat top surface 22, a convex outer surface 110 (FIG. 5) adjacent the concave outer surface 108, and a laterally extending outer surface 112 (FIG. 5) adjacent the convex outer surface 110 that extends to the tire portion 26, and vane 32 comprises an outer surface between outer edge 90 and outer edge 91 that includes a concave outer surface 114 (FIGS. 2, 6, and 6A) adjacent the flat top surface 22, a convex outer surface 116 (FIGS. 2, 6, and 6A) adjacent the concave outer surface 114, and a laterally extending outer surface 118 (FIGS. 2, 6, and 6A) adjacent the convex outer surface 116 that extends to the tire portion 26. In other contemplated embodiments, the forward body portion of the bit holder includes at least one vane and at least one cavity, where the cavities can be of various shapes. The combination and configuration of the vanes 28, 30, 32 and cavities 34, 36, 38 are configured to direct and move material from a trenched area to the adjacent surface alongside the trenching machine.

Figure 6A:
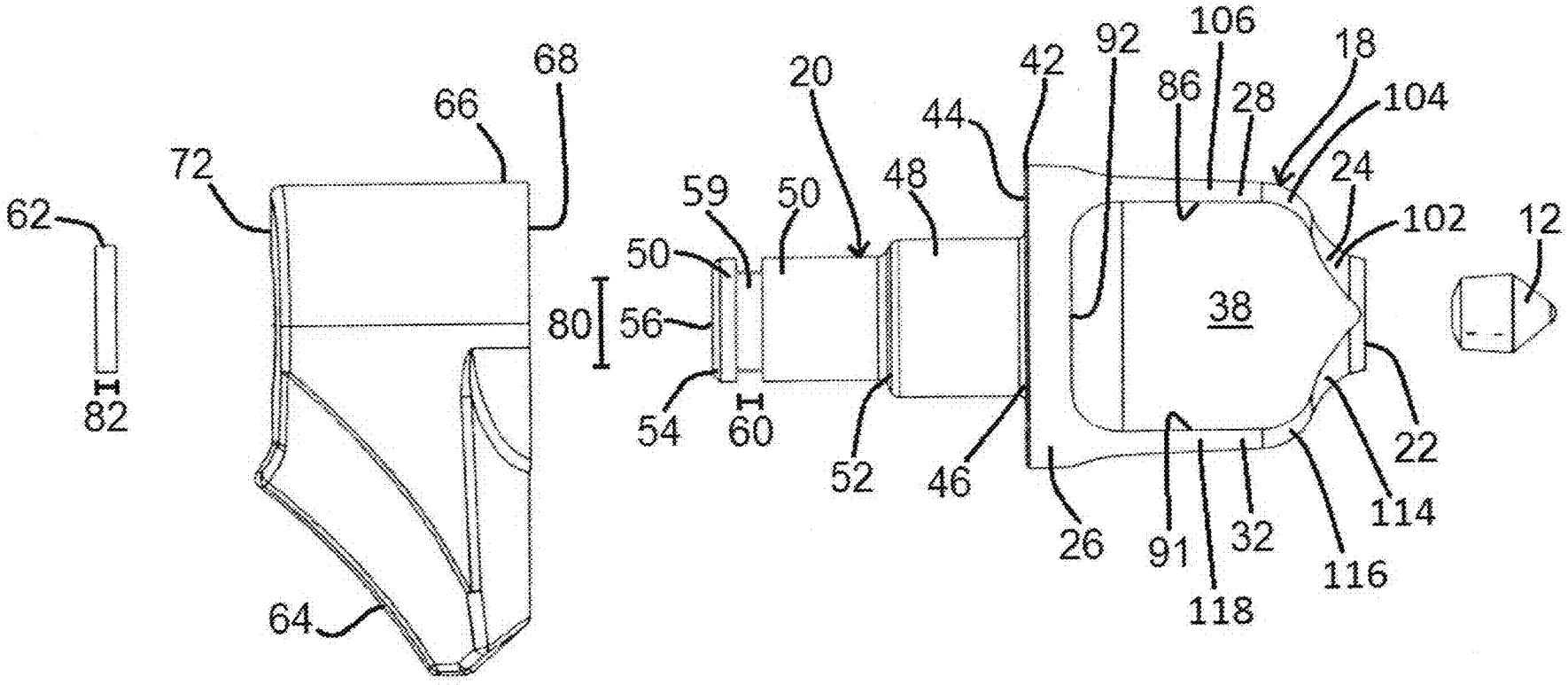
FIG. 6A is an exploded side elevation view of the embodiment of the bit assembly of FIG. 1.

The shank 20, coaxial with the bit holder body 18, axially depends from the decreased diameter tapered distal portion 46 of the bit holder body 18. The shank 20 may be solid and may have a single diameter along its entire length, or may have sections of varying diameters. In other embodiments, the shank 20 can be cylindrical or can include tapered and/or arcuate segments. The shank 20 in the illustrated embodiment comprises a generally cylindrical increased diameter first segment 48 that axially extends from the decreased diameter tapered distal portion 46 and a generally cylindrical decreased diameter second segment 50. The first segment 48 is joined to the second segment 50 by a shoulder 52. The second segment 50 axially extends from the shoulder 52 to a tapered distal segment 54 which axially extends to a distal end 56 of the shank 20. The second segment 50 includes an annular groove 58, having an axial length 60, shown in FIG. 6, adjacent the distal end 56 of the shank 20 where it can be engaged by a bit retainer 62. The annular groove 58 of the shank 20 can include an arcuate inner surface, as shown in FIG. 6, or a flat inner surface 59, as shown in FIG. 6A.

Figure 7:
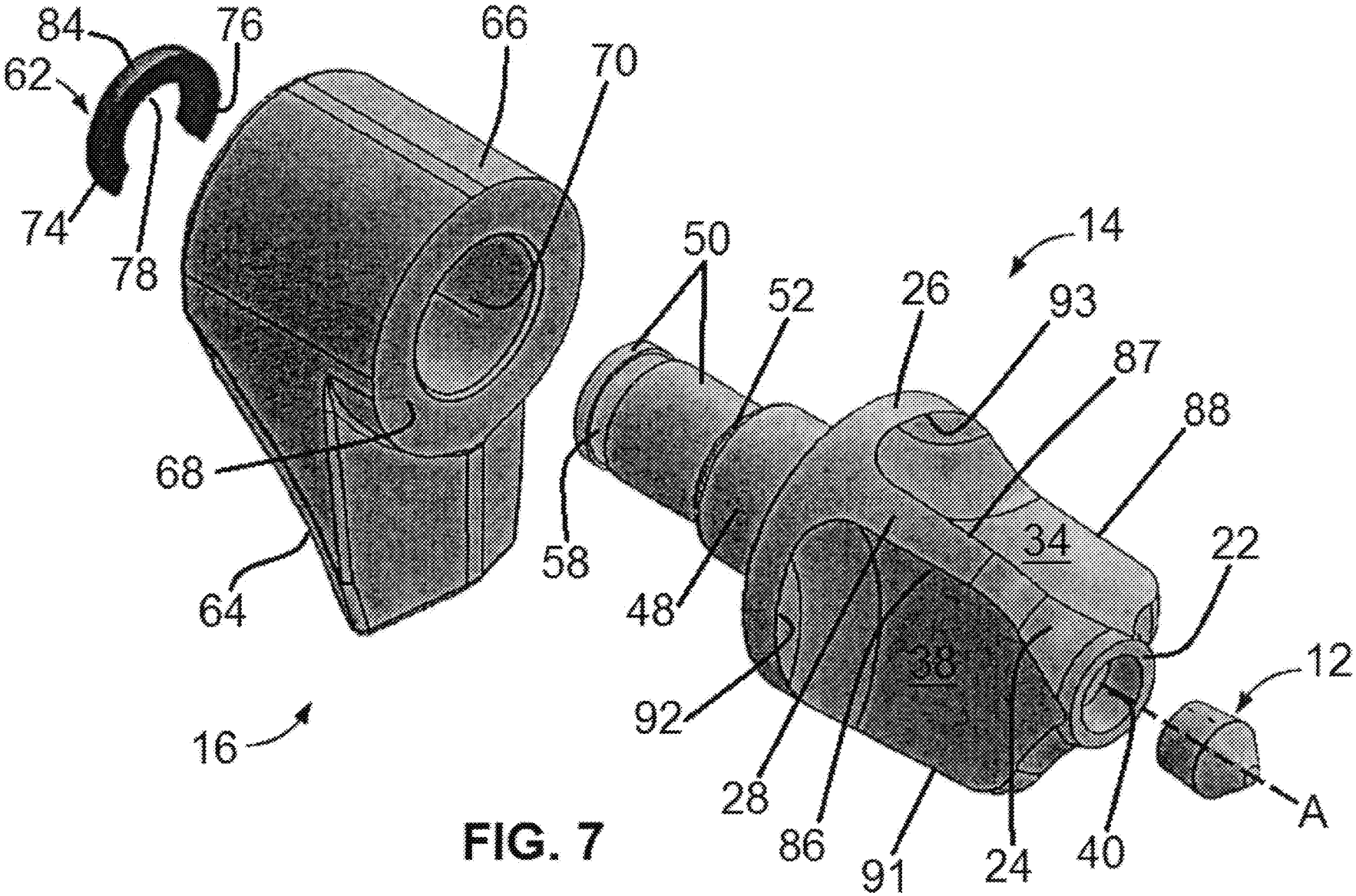
FIG. 7 is an exploded perspective view of the embodiment of the bit assembly of FIG. 1.

The bit retainer 62 includes a metal body having a thickness 82, shown in FIG. 6. The bit retainer 62 includes a pair of arcuate legs 74, 76 that define an aperture 78 of the bit retainer 62, as shown in FIG. 7. A diameter 80, shown in FIGS. 1 and 6, of the aperture 78 is generally at least the diameter of the annular groove 58 of the shank 20, such that the bit retainer 62 can fit around the annular groove 58 of the shank 20. Legs 74, 76 are joined together by an arcuate portion 84, shown in FIG. 7, that defines a radially expandable area.

Referring to FIGS. 6 and 7, the base block 16 comprises a base 64 and a front end 66 having a forward face 68. The base 64 can be flat or slightly concave to fit a drum or additional mounting plates on which a plurality of base blocks can be mounted. The front end 66 includes a base block bore 70 that is coaxial with the shank 20.

Figure 1:
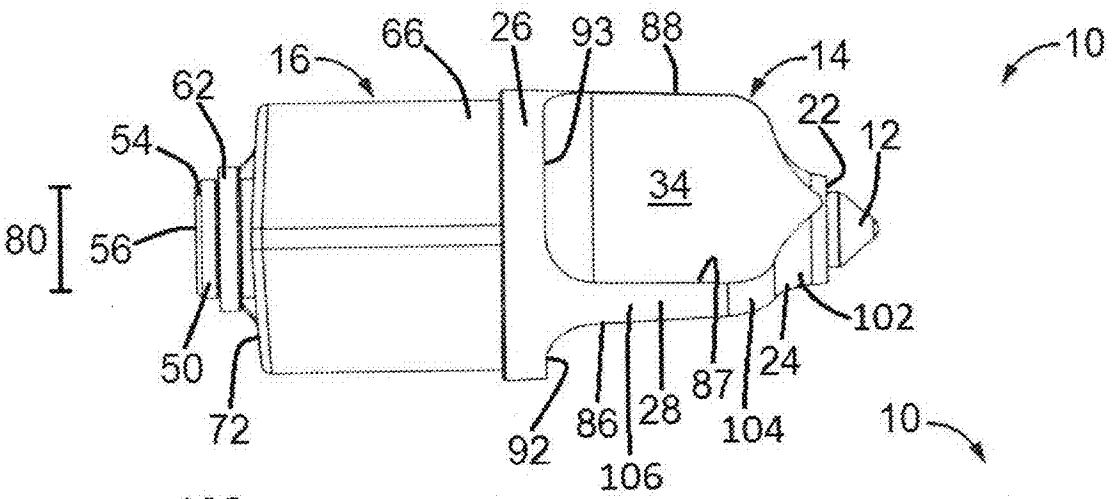
FIG. 1 is a top elevation view of an embodiment of a bit assembly.
Figure 3:
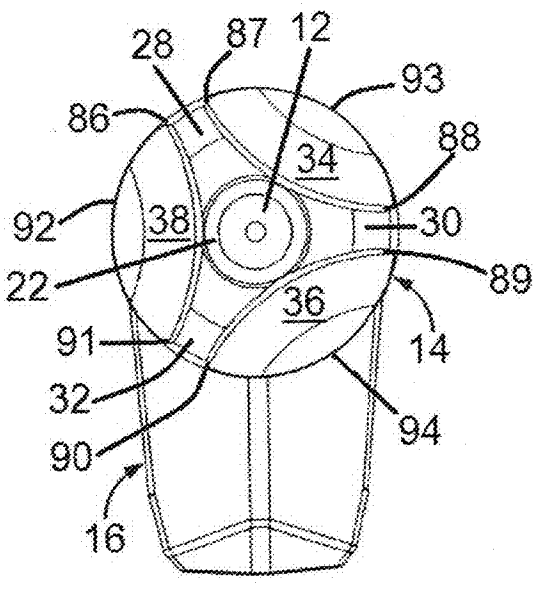
FIG. 3 is a front elevation view of the embodiment of the bit assembly of FIG. 1.
Figure 2:
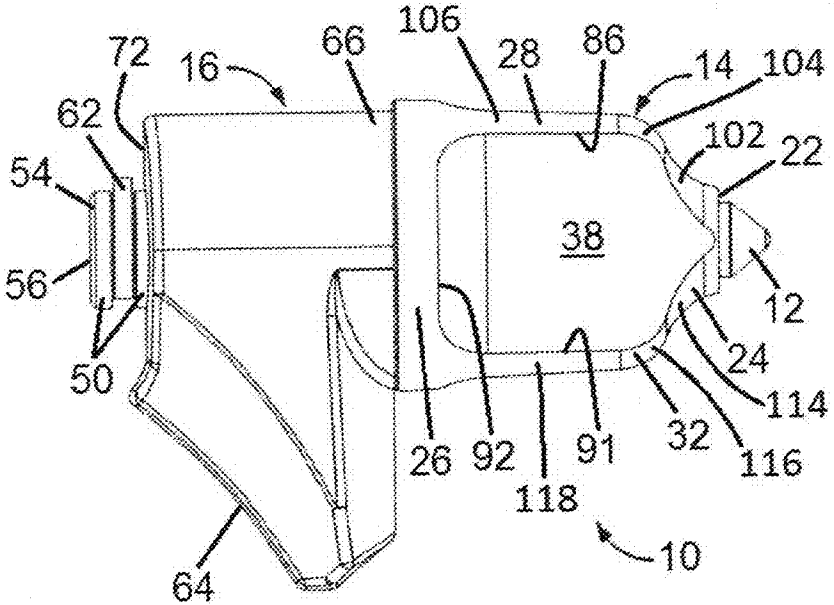
FIG. 2 is a right side elevation view of the embodiment of the bit assembly of FIG. 1.
Figure 5:
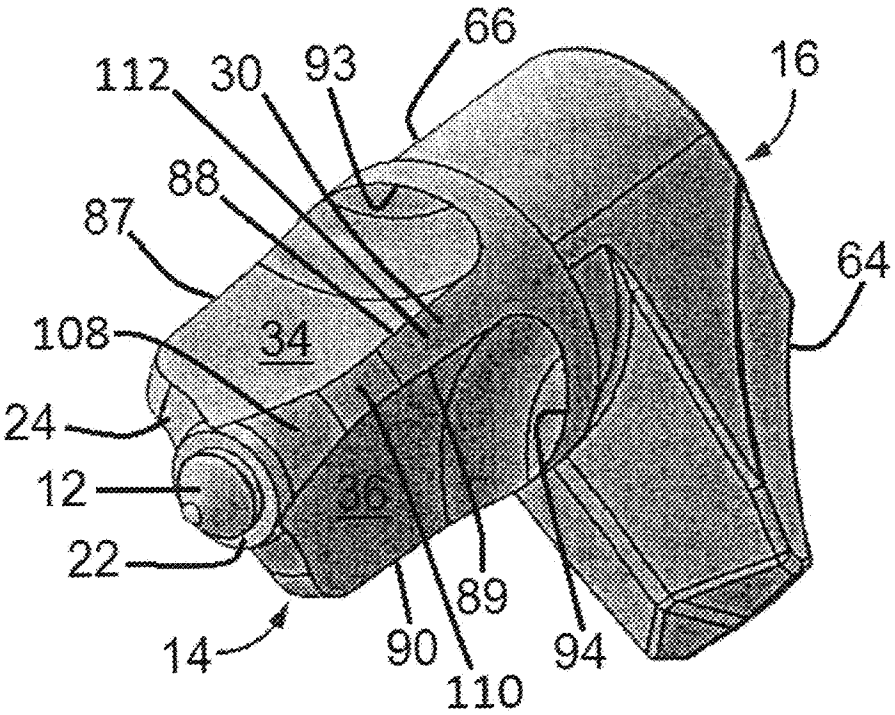
FIG. 5 is a left side perspective view of the embodiment of the bit assembly of FIG. 1.
Figure 4:
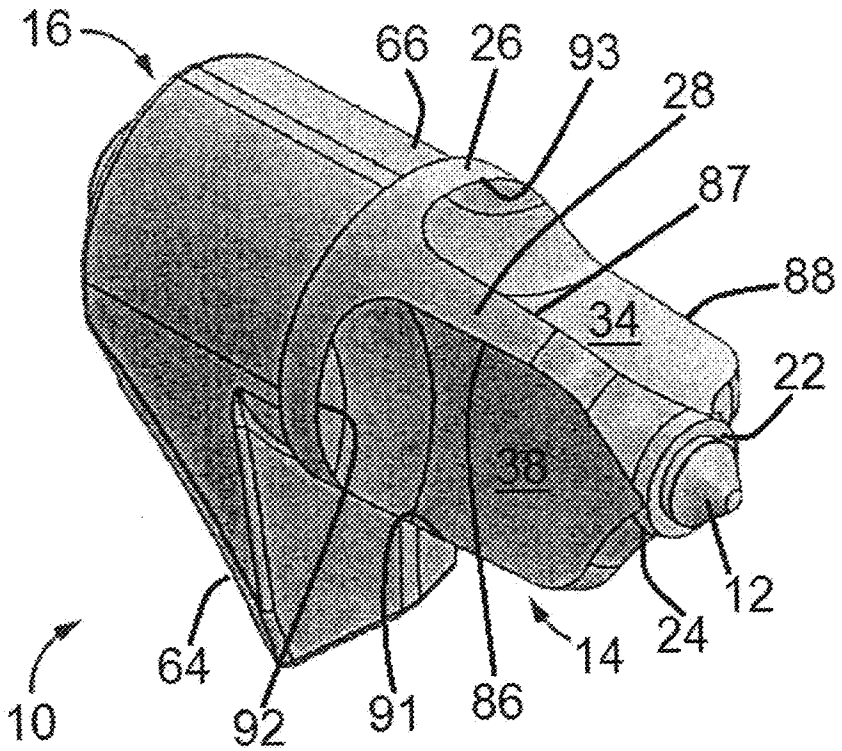
FIG. 4 is a right side perspective view of the embodiment of the bit assembly of FIG. 1.

The insert 12 is positioned and brazed in the generally cylindrical bore 40 of the flat top surface 22 of the bit holder body 18. The bit holder 14 is then inserted into the base block bore 70 of the front end 66 of the base block 16, forming a minimally spaced contact between the shank 20 and the base block bore 70. The bit holder 14 and the base block 16 are assembled together to form the bit assembly 10 (FIG. 2). The bit holder body 18, shank 20, bore 40, front end 66, and base block bore 70 of base block 16 are axially aligned when assembled together to form the bit assembly 10. The shank 20 extends beyond a rearward face 72 of the base block 16 so that the annular groove 58 can be engaged by the bit retainer 62.

The legs 74, 76 of the bit retainer 62 are fitted into the annular groove 58 of the shank 20. The thickness 82 of the bit retainer 62 is less than the axial length 60 of the shank 20 such that the legs 74, 76 can slidably engage the annular groove 58 until the arcuate portion 84 becomes engaged with a complementarily-shaped portion of the annular groove 58. The bit retainer 62 has an outer dimension larger than the diameter of the portion of the base block bore 70 extending through the rearward face 72 of the base block 16. Once fully engaged and assembled, the bit retainer 62 retains the bit holder 14 within the base block bore 70 of the base block 16.

While the present disclosure has been described in connection with certain embodiments, it is to be understood that the invention is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A bit holder comprising:

a forward body portion comprising a plurality of vanes axially and radially extending from a top surface of the body portion to a circumference of a generally cylindrical tire portion of the body portion, each vane of the plurality of vanes comprising a concave outer surface adjacent the top surface of the body portion, a convex outer surface adjacent the concave outer surface, and a laterally extending outer surface adjacent the convex outer surface;

a plurality of arcuate cavities, each arcuate cavity of the plurality of arcuate cavities comprising an entirely continuous radially concave surface extending laterally between two vanes of the plurality of vanes; and a generally cylindrical shank depending axially from the forward body portion, the shank comprising an annular groove adjacent a distal end of the shank.

2. The bit holder of claim 1, wherein each arcuate cavity of the plurality of arcuate cavities axially extends from adjacent the top surface to adjacent the tire portion.

3. The bit holder of claim 1, wherein each arcuate cavity is defined by a first outer edge of a first vane, a second outer edge of a second vane adjacent to the first vane, and an upper edge of the tire portion.

4. The bit holder of claim 1, wherein the plurality of cavities and the plurality of vanes are adapted to direct and move material from a terra *firma* to a surface adjacent a trenching machine.

5. The bit holder of claim 1, further comprising:

a generally cylindrical bore disposed in the top surface, the bore axially and centrally positioned in the bit holder.

6. The bit holder of claim 5, further comprising:

an insert centrally positioned within the bore of the top surface, the insert adapted to be brazed in the bore of the top surface.

7. The bit holder of claim 1, wherein the body portion extends axially and radially outwardly from the top surface to the tire portion.

8. The bit holder of claim 1, further comprising:

a chamfer extending from the tire portion to a rear flange of the body portion.

9. The bit holder of claim 1, further comprising:

a decreased diameter tapered distal portion adjacent the tire portion, the distal portion axially extending to the shank.

10. The bit holder of claim 1, wherein the plurality of vanes converge proximate an axis of rotation on the top surface of the bit holder and diverge radially towards the tire portion.

11. The bit holder of claim 1, wherein the shank comprises:

a generally cylindrical increased diameter first segment subjacent the body portion;

a generally cylindrical decreased diameter second segment subjacent to the first segment; and a shoulder disposed between the first segment and the second segment, the second segment axially extending from the shoulder to a tapered distal segment that axially extends to the distal end of the shank.

12. The bit holder of claim 11, wherein the second segment comprises the annular groove adjacent the distal end of the shank.

13. The bit holder of claim 1, further comprising:

a retainer adapted to slidably engage the annular grove of the shank and adapted to maintain the bit holder within a bore of a base block, the annular groove of the shank extending beyond a rearward face of the base block.

14. The bit holder of claim 13, wherein the retainer comprises an outer diameter larger than a diameter of the shank.

15. The bit holder of claim 13, wherein the retainer comprises an inner diameter that is at least a diameter of the annular groove.

16. The bit holder of claim 13, wherein the retainer comprises a pair of arcuate legs disposed on opposite side of an arcuate portion, the arcuate portion defining a radially expandable area.

17. The bit holder of claim 16, wherein the arcuate portion is adapted to engage a complementary shaped portion of the annular groove.

18. The bit holder of claim 13, wherein the retainer comprises a thickness that is less than an axial length of the annular groove of the shank.

19. The bit holder of claim 1, wherein the annular groove comprises one of an arcuate inner surface and a flat inner surface.

20. A bit holder comprising:

a forward body portion comprising at least one vane axially and radially extending from a top surface of the body portion to a circumference of a generally cylindrical tire portion of the body portion, the at least one vane comprising a concave outer surface adjacent the top surface of the body portion, a convex outer surface adjacent the concave outer surface, and a laterally extending outer surface adjacent the convex outer surface;

at least one arcuate cavity comprising a continuous radially concave surface extending laterally between outer edges of the at least one vane; and a generally cylindrical shank depending axially from the forward body portion, the shank comprising an annular groove adjacent a distal end of the shank.

* * * * *